United States Patent [19]

Lewiner et al.

[11] Patent Number: 4,485,381

[45] Date of Patent: Nov. 27, 1984

[54] CODED ELECTRONIC LOCKING DEVICES

[76] Inventors: Jacques Lewiner, 5, rue Bory d'Arnex, 92210 Saint-Cloud; Claude Hennion, 18, rue Flatters, 75005 Paris; Gilbert Berthier, 17, Avenue de Madrid, 92200 Neuilly, all of France

[21] Appl. No.: 385,103

[22] Filed: Jun. 4, 1982

[30] Foreign Application Priority Data

Jun. 4, 1981 [FR] France ..... 81 11102

[51] Int. Cl.[3] ..... E05B 47/00

[52] U.S. Cl. ..... 340/825.31; 361/172; 340/825.56

[58] Field of Search ..... 340/825.31, 543, 825.56; 361/172

[56] References Cited

U.S. PATENT DOCUMENTS 3,764,982 10/1973 Kidnocker, Jr. ..... 340/825.32

3,825,898 7/1974 Miller ..... 340/825.31

4,340,925 7/1982 Lewiner et al. ..... 361/172

FOREIGN PATENT DOCUMENTS 2016576 9/1979 United Kingdom .

*Primary Examiner*—Donald J. Yusko

*Attorney, Agent, or Firm*—Larson and Taylor

[57] ABSTRACT

The invention relates to a coded locking device actuated by successive pushes on two buttons. This device comprises means for converting the pushes on the two buttons into electrical pulses emitted respectively along two channels and an electronic unit adapted to identify the pulse trains successively emitted in the two channels, to count the numbers of pulses of the different successive trains, to compare each sequence of pulse trains with a memorized reference or code sequence and to emit an unlocking signal S if the two sequences are identical. To form each sequence of actual pulses, the user can start by pressing either one of the two buttons.

9 Claims, 9 Drawing Figures

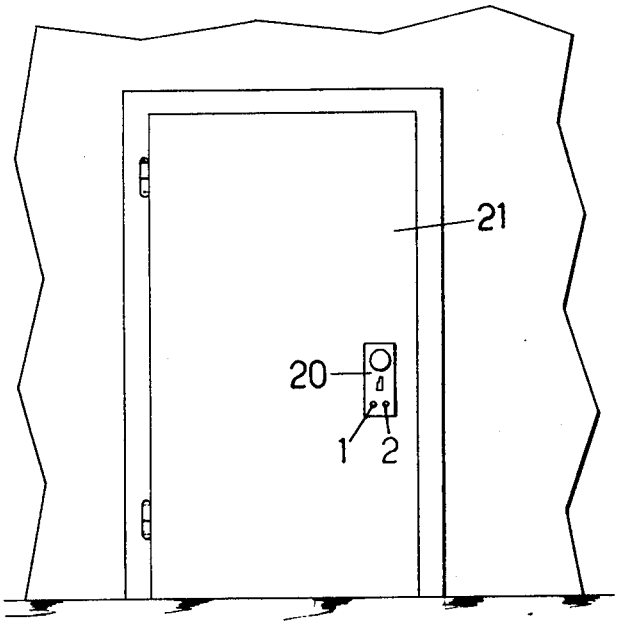
Fig.1.
Fig.2.
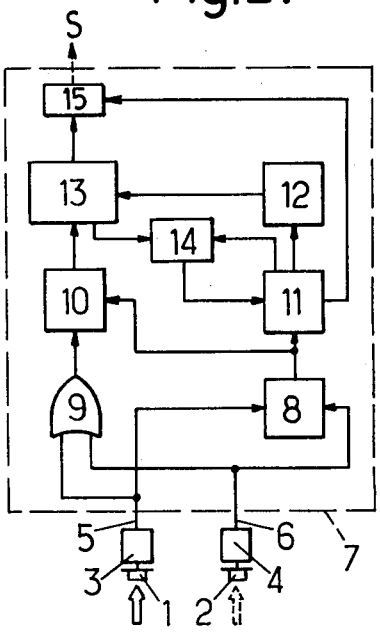
Fig. 3.
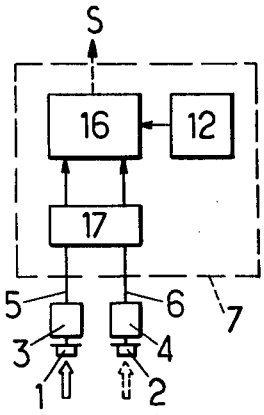
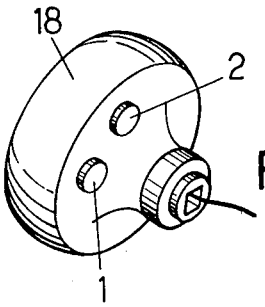
Fig.4.
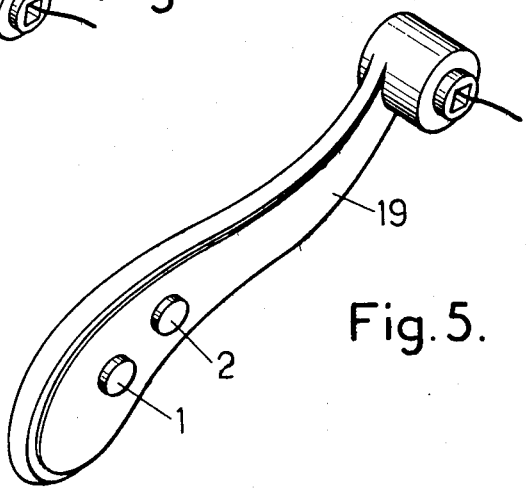
Fig.5.

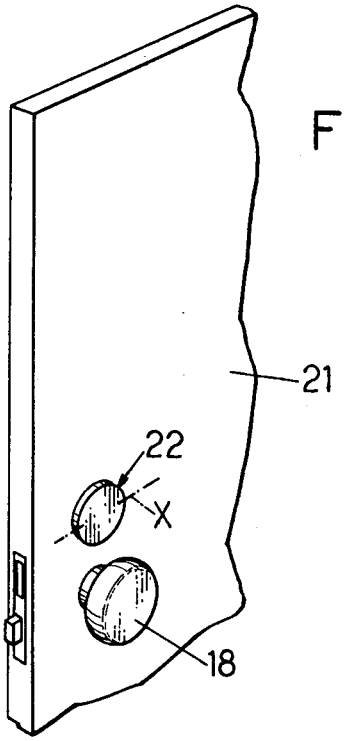
FIG. 6.
FIG. 9.
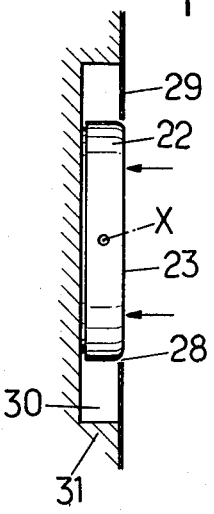
FIG. 7.
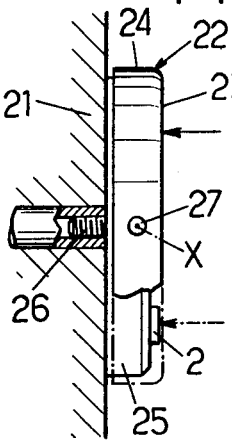
FIG. 8.
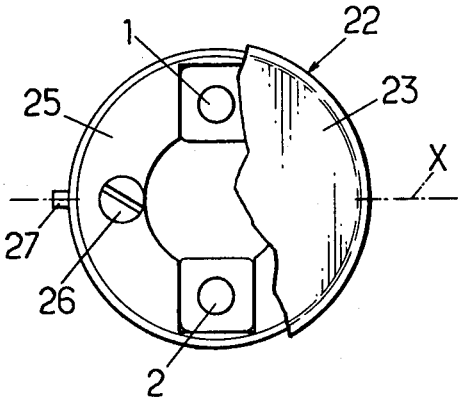

CODED ELECTRONIC LOCKING DEVICES

The invention relates to electronic locking devices and more particularly to those, among these devices, for which the unlocking order requires the formation of a sequence of electrical pulses whose composition corresponds to a predetermined "reference" code previously memorized in the device, each of said pulses being generated by the pressure of a finger of a user, knowing the code, on a suitable key.

In the most current embodiments of locking devices of this type, the actuating keys for generating the coded sequence of pulses form part of an actuating keyboard comprising not only these keys, but also other similar ones, and all the keys of this keyboard are individually identified.

These devices have certain drawbacks, in particular as regards the difficulty of locating in semi-darkness the keys of the keyboard to be actuated, the posssibility of reconstituting the reference code by examining the most worn keys, the bulk, the complexity and accordingly the relatively high cost.

A formula to avoid these various drawbacks would consist of reducing the keyboard to a single key. However this formula can hardly be adopted by reason of the too small number of coded combinations which it makes possible, this number being practically limited to that of successive pushes of a user's finger on the key concerned.

In fact, it is scarcely conceivable in practice, with such a single key, to exploit a sequence of successive pulse trains formed by successive pushes of a user's finger on this key in view of the almost impossibility encountered in practice by the user of respecting, on the one hand, duration maxima thresholds for the intervals between successive pushes corresponding to the various pulses of the same train and, on the other hand, duration minima thresholds, higher than the abovesaid maxima thresholds, for intervals between successive trains, whilst the respect of these two thresholds is absolutely necessary in order that the electronic system may be able to differentiate between the various trains.

To avoid the above-mentioned drawbacks, it has been proposed to resort to two push-buttons adapted respectively for the formation of 0 and of 1 in binary code and actuated in their turn according to the binary entry of a coding number corresponding to the reference code.

This formula has still a certain number of drawbacks, in particular in that it requires of the user, on the one hand, the locating, with exact identification, of the two buttons associated respectively with the formation of the 0's and that of the 1's and, on the other hand, knowledge of a binary coding number particularly difficult to retain due to the fact of the large number of its figures, and in that it offers less security in view of the relatively small number of combinations corresponding to a reasonable number of these figures, this number of combinations being only 128 for a binary coding number with seven figures.

It is a particular object of the invention to overcome these various drawbacks.

Accordingly, according to the invention, there are provided electronic locking devices, which are of the type comprising two push-buttons, means associated with these two buttons to convert their respective actuations to electrical pulses emitted respectively in two parallel channels, and an electronic decoding unit to receive and exploit these electrical pulses for the purpose of emitting an unlocking signal when the composition of the sequence of these pulses corresponds to the reference code, and which are characterised in that their electronic unit is arranged so as to identify in turn the various trains of pulses generated successively in the two channels by each sequence of actual actuations of the two buttons, counting the numbers of pulses comprised by each of the different trains thus identified and comparing for decoding purpuses the complete composition of each real sequence of pulses thus analysed with the complete sequence composition corresponding to the previously memorized reference code, and to emit the unlocking signal each time that the comparison reveals identity between the real sequence and the coded sequence, said electronic unit comprising zero re-set means and being arranged so that after each resetting to zero, the sequence of actual actuations of the two buttons intended to unlock the device may be executed by commencing indifferently by pushing either one of the two buttons.

By "push-button" or more simply "button", is meant here and in the following, both a push-button proper, comprising a bearing element adapted to be moved under the pressure of a finger against an elastic return force, and more generally any control member having a receiving area for a finger and arranged so as to exploit for actuating purposes the placing in contact of a finger with such an area.

At this point of the description, it is useful to recall that it has been proposed, in French patent application No. 80/01673 filed Jan. 25, 1980, to construct an electronically actuated lock in which the decoding exploits a sequence of electrical pulse trains formed in turn according to a predetermined code over two distinct channels.

However, in this lock, the trains are generated by the thrusts, at least angular, of a rotary key in respectively its two possible rotary directions: this type of device certainly is advantageous in certain cases, but is derived from a fundamentally different principle from that of the keys actuation applied according to the present invention.

In preferred embodiments of the latter, recourse is had in addition to one or other of the following features:

the two buttons are mounted in a location hardly visible or invisible to users of the unlocking device, the two buttons are mounted on the actuating handle of a locking bolt, the two buttons are actuatable by a single tumbler urged constantly towards a middle inactive position by elastic means, the tumbler according to the preceding paragraph is constituted by a cap having a flat bottom and a peripheral edge of a relatively small constant height, which cap is mounted to be rockable around an axle parallel to its bottom and passing through its edge, the bottom of the cap according to the preceding paragraph is constantly in contact with each of the two buttons, which are located on each side of the rocking axle, the outer surface of the bottom of the cap according to the two preceding paragraphs, which surface forms a thrust area for the fingers of the user, is flat, hard, smooth and relatively large, its surface area being comprised between 10 and 30 $cm^2$, the outer surface of the bottom of the cap according to the preceding paragraph is in the form of a disk whose radius is comprised between 4 and 6 cm, the edge of the cap having a height comprised between 5 and 7 mm, the outr surface of the bottom of the cap is flush with the outer surface of a plate at the level of the edge of a hole formed in this plate and occupied by this cap.

The invention comprises, apart from these main features, certain other features which are preferably used at the same time and which will be more explicitly considered below.

In the following, preferred embodiments of the invention will be described with reference to the accompanying drawings given of course purely by way of non-limiting illustration.

FIG. 1, of these drawings, shows a door equipped with an embodiment of a code locking device constructed according to the invention.

FIGS. 2 and 3 respectively show diagrammatically two electronic units capable of being included by such a device.

FIGS. 4 and 5 show respectively in perspective view two handles of a door equipped with pairs of push-buttons forming part of a locking device according to the invention.

FIG. 6 shows in partial perspective view a door equipped with a pair of push-buttons of the above-mentioned type associated according to the invention with a common actuating tumbler.

FIGS. 7 and 8 show said common tumbler respectively in lateral view, with parts torn away, and in front view, with parts torn away.

FIG. 9 shows diagrammatically another mode of assembly according to the invention of such a tumbler.

In each case, the locking device is intended to emit a signal S adapted to ensure effective unlocking, in response to the application to it of a sequence of electrical pulse trains whose composition corresponds exactly to that of a reference or "code" sequence previously memorized in this device.

To this end, this locking device has been made to comprise:

two push-buttons 1 and 2 (FIGS. 1 to 5) or similar keys in the above-defined sense, of which certain modes of mounting and of actuation will be specified below, members 3 and 4 (FIGS. 2 and 3) for converting the pushes on these buttons into electrical pulses emitted respectively in two distinct channels 5 and 6, and an electronic unit 7 adapted to exploit for decoding purposes by comparison with the one or more reference codes memorized, each sequence of pulse trains emitted successively in the two channels 5 and 6 in response to the thrusts concerned on said buttons.

The members 3 and 4 designed to generate electrical pulses in the two channels 5 and 6 in response to the actuation of the buttons 1 and 2 may be arranged in any desirable manner: they are in particular constituted by electrical switches mounted in electrical supply circuits, or indeed by transducers adapted to exploit for the purposes of the creation of electrical pulses the variations of a contact pressure (electromechanical transducers), or those of a capacity, which may or may not be equipped with an electret (electrostatic transducers), or again those from a magnetic circuit adapted notably to generate a voltage by the Hall effect (electro-magnetic transducers), etc.

Two embodiments of the electronic unit 7 have been shown diagrammatically in FIGS. 2 and 3 respectively.

The first of these two units 7, shown diagrammatically in FIG. 2, includes:

a "channel change" flip-flop 8 to which are connected the two channels 5 and 6, which flip-flop is arranged so as to swing over each time it receives a pulse coming from a new channel and to emit a pulse each time that it swings over, an AND gate 9 supplied, like the flip-flop 8, through the two channels 5 and 6, a pulse counter 10 receiving the output from the gate 9 and re-set to zero by the output from the flip-flop 8 on each "channel change", an address counter 11 receiving also the output from the flip-flop 8 and arranged so that its contents passes to 1 on reception of the first pulse of each sequence to be decoded and increases by 1 on each channel change, a memory 12 in which the reference code has been recorded, which code is composed of a sequence of "address" numbers, this memory receiving the output from the address counter 11, a comparator 13 receiving both the output from the pulse counter 10 and that from the memory 12 on each change in the contents of the address counter 11, an error signal generating member 14 whose inputs are connected to the address counter 11 and to the comparator 13 and adapted to re-set the pulse counter 10 and the address counter 11 to zero as soon as a manipulation reveals itself to be incorrect (after a relatively short delay $t_0$), due to the fact particularly of a faulty identity between the number of pulses of a train applied to the comparator 13 and the corresponding reference number then delivered by the memory 12, or again on exceeding the number of addresses, or after a maximum time $t_1$ authorized for the decoding operation (for example 20 seconds) has been exceeded, and an actuator 15 receiving the outputs from the address counter 11 and from the comparator 13 and adapted to form in consequence the deblocking signal S at the end of the decoding if the latter is shown to be correct, possibly after a slight delay, for example of the order of 0.5 to 1 second.

The "wired logic" circuit constituted by the above circuits 8 to 15, discrete or integrated, could be replaced by a logic system programmed by micro-processors or micro-computers: the latter construction has the advantage of very small size; it has also the advantage of very small consumption, in particular when it is associated with means ensuring its automatic placing in "watching" or rather "dormant" condition after a certain delay subsequent to the first decoding pulse. Of course, for such a condition, the electrical consumption is practically nil, being limited to that just sufficient to preserve the memories; a special circuit is then of course provided to "awaken" the unit on the start of each decoding operation.

It is the second example of an electronic unit 7 which has been shown diagrammatically in FIG. 3. This unit comprises, in addition to the memory 12, a micro-computer 16 and an awakening circuit 17. The latter circuit, the only one constantly in operation or "in watching" state, is of very low electrical consumption type, for example a C.MOS integrated circuit. Its purpose is to start up or "awaken" the microcomputer 16 as soon as an electrical pulse arrives thereat from one of the two channels 5 and 6. This micro-computer then records in an internal memory the composition of the pulse sequence that it receives, compares it with the reference or code composition contained in the memory 12 and emits a signal S if there is identity between the two compositions thus compared. In the contrary case, the microcomputer becomes indifferent to the pulses it receives for a predetermined period which may be of the order of 10 seconds.

After each correct decoding, or after each anomaly, the microcomputer is automatically restored to its dormant state for which its electrical consumption is practically nil.

This microcomputer could be replaced by a microprocessor associated with peripheral circuits such as a programmed memory and input-output devices.

The electrionic unit 7 may comprise also a battery (not shown) for its electrical supply (which supply is reduced when inactive to that of the watching circuit, when such is provided): this battery can serve for supplying also a circuit adapted to exploit the unlocking signal S, if the latter circuit is arranged for low consumption.

The operation of the unlocking device as described above is as follows.

It requires only knowledge of the code, which is in the form of a number of n figures or an equivalent group.

Thus the code 7519 corresponding to a number n equal to 4 may be assimilated to the four letters of the word GEAI, easier to remember, of which letters the respective ranks in the alphabet are 7, 5, 1 and 9.

Knowing this code, it suffices for the user to press first one of the two buttons 1 and 2 a number of times equal to the first figure of the code, then on the other button a number of times equal to the second figure of the code, then again on the first button a number of times equal to the third figure of the code and so on until the completion of the succession of pushes of rank n: the unlocking signal S is then emitted by the actuator 15.

This signal S can be exploited for all desirable purposes such as the opening of a door—which door can give access, for example, to a building, to an apartment or to a safe—the unlocking of an automobile vehicle steering wheel, the electrical supply to an apparatus and the like.

It should be noted that, to ensure the above unlocking, the user holding the code may start by pushing any one of the two buttons 1 and 2.

This is a principal advantage of the present invention since, as a result, it is unnecessary for users to identify exactly the two buttons concerned and the latter may hence be arranged in locations where they are locatable only by touch, then being out of sight to the users.

Such an arrangement of buttons hidden from sight has also the important advantage of hiding at least in part the manipulations of these buttons, which renders more difficult, or even impossible, even in full daylight, identification of the code by third parties witnessing said manipulations.

As a result also from the fact that it is unnecessary to see the buttons to actuate them, their manipulation can take place in darkness and may even be carried out by blind or poor-sighted users.

The actuations concerned may even be ensured "in reverse" without any risk of error as is the case when these buttons are provided on a rear surface of a knob-form locking handle 18 (FIG. 4) or on the lower surface of a duck-bill shaped locking handle 19 (FIG. 5).

This possibility of mounting the buttons "on the back side" without risk of error also permits automatic solving of the problem posed by the safety actuation of the same door lock from the two sides of this door, which actuations are often reversed and then require reversed sequences of manipulations for the two sides of the door.

It will be noted, in addition, that the replacement of known actuating keyboards by only two buttons leads to a considerable reduction in the bulk of the locking device, which reduction permits in particular, direct mounting of this device on the housing 20 of a door lock 21 (FIG. 1), and even such mounting directly on a handle, as has been indicated above with reference to FIGS. 4 and 5.

It may be added that, if the two buttons are sufficiently close, they can be actuatable by two fingers of the same hand without it being necessary to move this hand in the course of each complete unlocking manoeuvre. This circumstance further reduces the possibility of identification of such manipulations by eye witnesses.

In particularly advantageous embodiments, the two buttons are actuated from the same tumbler elastically urged constantly into a middle inactive position.

The pressing area of this tumbler can have any desirable shape, for example, that of a dihedral widely open outwardly and with a crest parallel to the rocking axle: in such a case the thrusts exerted respectively on the two faces of the dihedral serve respectively for actuating the two buttons.

In the cases illustrates in FIGS. 6 and 9, the tumbler concerned, denoted by the reference numeral 22, is in the form of a cap having a flat bottom 23 and a peripheral edge 24 of relatively small constant height perpendicular to said bottom, the rocking axis X of this cap being parallel to the bottom 23 and passing through the edge 24.

Special elastic means may be provided to bring back this cap constantly into its middle inactive position.

However, it may be advantageous to ensure this return by using elastic means which have already been provided to return each of the two buttons into its protruded resting position.

To this end, the cap 22 is mounted so that its bottom 23 remains constantly in contact with each of the two buttons 1 and 2 or in positioned only at a very small distance from these buttons in its resting position: it is the first of these two hypotheses which has been adopted in FIG. 7.

The outer surface of the bottom 23, forming a pressing area for the fingers of the user, is preferably flat, hard, smooth and relatively large, its surface generally being comprised between 10 and 30 $cm^2$.

The cap may for this purpose, be constituted from a stamped metal plate smoothed externally by any desirable means such as brushing or a suitable plating of chromium or other metal.

The general shape of the bottom 23 may be that of a square, or of a rectangle (with the large side of this rectangle parallel or perpendicular to the axle X), or of an isosceles or equilateral triangle (with the axis of symmetry of this triangle parallel or perpendicular to the axle X), or of a trapezium, etc.

In the preferred embodiment illustrated, it is a disk whose radius is comprised between 4 and 6 cm, the peripheral edge 24 then having a height comprised between 5 and 7 mm.

The actuation of the two buttons 1 and 2 is ensured by exerting an alternated sequence of pushes in accordance with the code on respectively the two halves of the bottom 23 situated on each side of the axle X.

This axle X may be oriented horizontally or vertically.

If it is horizontal, the different pushes may all be executed successively by means of the same finger of the user, generally a thumb or an index finger.

If the axis X is vertical, the different pushes can easily be executed by means of the index finger and the middle finger of the same hand of the user, oriented upwardly.

In all cases, the thus-ensured operation is particularly easy, even pleasant: in fact, due to the fact that the pressing area is relatively large and smooth, the position of each push is not precisely imposed and it is possible to envisage the actuating finger sliding over said area, without loss of contact, from a position corresponding to the actuation of one button to a position corresponding to the actuation of the other button.

Of course, due to the fact that the pressing area is relatively large and flat, it is possible to use it to receive any symbol or design.

It is also possible to provide for the formation on this bottom of the neutral area corresponding to the axis by a rib or groove in order to facilitate touch recognition of this area in certain cases.

In FIGS. 7 and 8, there is seen a ring 25 fixed by screws 26 to a suitable support (here the door 21) and adapted to receive on the one hand the buttons 1 and 2 and on the other hand pins 27 of axis X, the rocking mounting of the cap 22 on these pins 27 having the effect of causing said ring to be covered almost contiguously by said cap.

In the modification shown diagrammatically in FIG. 9, the cap 22 appears through a complementary hole 28 formed in a plate 29 adapted to close itself a cavity 30 formed in masonry 31: the bottom 23 of this cap is then exactly flush with the flat outer surface of said plate 29, in its resting state.

Whatever the embodiment adopted, the locking device according to the invention eliminates almost entirely all of the drawbacks indicated above for known solutions of button actuated locking devices.

In particular, the code enabling unlocking can easily be remembered by users, in view of the fact that this code is composed of a number n of figures or letters which is relatively small, this number being for example equal to 3, 4 or 5.

In spite of this simplicity, the number of coded combinations possible is very high: thus if the number of consecutive actuations of each buttons is comprised between 1 and 16: the number of coded combinations possible is 65536 for a number n equal to only 4.

It may be added that with the solution according to the invention, it is not necessary to respect the maximum duration thresholds between successive actuations of a same button and the minimum duration thresholds between the last actuation of a button and the first consecutive actuation of another button: in fact, due to the fact that the electrical pulses corresponding to the actuations of the two buttons are emitted respectively in two distinct channels, the electronic system distinguishes automatically, in the sequence of pulses to be anaylsed, those which correspond to successive trains, and those which correspond to successive pulses of a same train.

We claim:

1. Coded electronic locking device for which the unlocking order requires the formation of a sequence of electrical pulses whose composition corresponds to at least one predetermined "reference" code previously memorized in the device, said device comprising two pushbuttons activated by axially exerted pressure thereon and each of said pulses being generated by the thrust of a finger of a user knowing the code on one or the other of said two push-buttons, said device further comprising means associated with said two buttons for converting their respective actuations into electrical pulses transmitted respectively in two parallel channels and an electronic decoding unit for receiving and producing an unlocking signal when the composition of the sequence of these pulses corresponds to the reference code, said electronic unit being arranged so as to identify in turn the different pulse trains generated successively in the two channels by each sequence of actual actuations of the two buttons, to count the number of pulses comprised by each of the different so-identified trains, to compare for decoding purposes the complete composition of each real sequence of pulses so analyzed with the complete sequence composition corresponding to the previously memorized reference code, and to produce the unlocking signal each time that the comparison reveals an identity between the real sequence and the code sequence, said unit including in addition zero re-set means for resetting the unit to zero, and said unit being arranged so that after each re-setting thereof to zero, the sequence of real actuations of the two buttons for unlocking the device can be carried out by commencing by pressing either one of the two buttons.

2. Locking device according to claim 1, wherein said two buttons are mounted in a position on the device which is hardly visible or invisible to users of the latter.

3. Locking device according to claim 1 or 2, wherein said two buttons are mounted on an actuating handle of a locking bolt.

4. Locking device according to claim 1, wherein said two buttons are actuatable by a single tumbler urged constantly towards a middle inactive position by elastic means.

5. Locking device according to claim 4, wherein the tumbler is constituted by a cap having a flat bottom and a peripheral edge of relatively small constant height, said cap being mounted rockably around an axle parallel to its bottom and passing through its edge.

6. Locking device according to claim 5, wherein the bottom of the cap is constantly in contact with each of the two buttons, which are located on each side of the rocking axle.

7. Locking device according to claim 5, wherein the outer surface of the bottom of the cap, forming a pressing area for the fingers of the user, is flat, hard, smooth and relatively large, having a surface area being of between 10 and 30 $cm^2$.

8. Locking device according to claim 7, wherein the outer surface of the bottom of the cap is in the form of a circle whose radius is comprised between 4 and 6 cm, the edge of the cap having a height comprised between 5 and 7 mm.

9. Locking device according to claim 5, wherein the outer surface of the bottom of the cap is flush with the outer surface of a plate at the level of the edge of a hole formed in this plate and occupied by said cap.

* * * * *